United States Patent [19]

Saito et al.

[11] 4,362,232

[45] Dec. 7, 1982

[54] STEP FOR PASSENGER CONVEYOR

[75] Inventors: Cyuichi Saito; Isamu Shiraki; Hiroshi Yumino, all of Katsuta, Japan

[73] Assignee: Hitachi, Ltd., Tokyo, Japan

[21] Appl. No.: 125,780

[22] Filed: Feb. 29, 1980

[30] Foreign Application Priority Data

Mar. 5, 1979 [JP] Japan ..... 54-24436

[51] Int. Cl.[3] ..... B66B 9/12

[52] U.S. Cl. ..... 198/333; 52/182

[58] Field of Search ..... 198/333, 321, 326–327, 198/334, 324–325; 52/31, 312, 177, 179, 182, 188

[56] References Cited

U.S. PATENT DOCUMENTS 1,130,555 3/1915 Wheeler ..... 198/333 X

FOREIGN PATENT DOCUMENTS 2161442 7/1972 Fed. Rep. of Germany ..... 198/333

40-16984 6/1965 Japan ..... 198/333

*Primary Examiner*—John J. Love

*Assistant Examiner*—Douglas D. Watts

*Attorney, Agent, or Firm*—Antonelli, Terry & Wands

[57] ABSTRACT

A step for a passenger conveyor has a tread formed with a plurality of cleats defining grooves therebetween and adapted to mesh with comb-shaped teeth provided on step-on and step-out landings, and side frames on which the tread is mounted. The tread is provided with flat and cleat-less mounting sections each having a width greater than the width of the groove between each adjacent pair of cleats. The tread is removably connected at the mounting sections to the side frame members. The flat mounting sections are covered with covering members removably mounted on the tread.

10 Claims, 8 Drawing Figures

STEP FOR PASSENGER CONVEYOR

BACKGROUND OF THE INVENTION

1. Field of the Invention

The present invention relates generally to passenger conveyors such as escalators and moving sidewalks and, more particularly, to the steps of the passenger conveyors.

2. Description of the Prior Art

In general, the escalator, which is one type of passenger conveyors, has an endless series of steps each comprising a tread, a pair of side frame members supporting the tread and a riser. On the other hand, the steps of moving sidewalks each comprise, in general, a tread and a pair of side frame members.

As disclosed in Japanese Utility Model Publication No. 40-16984(16984/65), for example, it has been a conventional technique in connecting a tread and side frame members together that through-holes are formed in the tread through the bottoms of grooves between cleats of the tread, similar through-holes are formed in the side frame members and bolts of a small diameter (usually 3 mm) are inserted into aligned through-holes in the tread and side frame members and screwed into nuts placed on the undersurfaces of the side frame members.

As such, the diameter of the bolts used is limited by the width of each of the grooves formed between the cleats on the tread. As a consequence, a large number of bolts (usually 20–30 bolts) are required to provide the necessary mechanical strength, with a result that the manufacture of a passenger conveyor step involves a large number of troublesome drilling and bolting steps.

SUMMARY OF THE INVENTION

It is, therefore, an object of the present invention to provide a passenger conveyor step which needs a reduced number of connecting bolts and thus can be manufactured by reduced number of drilling steps and simplified mounting operation.

According to one feature of the present invention, there is provided a step for a passenger conveyor, comprising a tread formed with a plurality of cleats defining grooves therebetween and adapted to mesh with comb-shaped teeth provided on step-on and step-out landings, and frame means on which the tread is mounted. The said tread is formed with at least one mounting section having no cleats and a width greater than that of the groove between each adjacent pair of cleats. The step is provided with means removably mounting the tread at the mounting section on the frame means, with the mounting section being covered with a covering member.

According to another feature of the present invention, the step is provided with means for removably mounting said tread at said mounting section on said frame so that mounting and removal of said tread can be effected from above the tread, with a means for removably mounting the covering member covering the tread so that the mounting and removal of said covering member can be effected from above said covering member.

According to a further feature of the present invention, the tread is removably secured to the frame means by means of bolts so that the removal of said tread can be effected from above said tread, with the said bolts being covered with at least one covering member.

According to a still further feature of the present invention, the tread is provided with flat sections formed along the opposite side edges of said tread and having no cleats. The said tread is removably connected at the flat sections to frame means so that the removal of tread can be effected from above the tread. The flat sections are covered with covering members removably mounted on the tread so that the removal of the covering members can be effected from above the covering member.

The present invention will be described by way of example with reference to the accompanying drawings.

DESCRIPTION OF PREFERRED EMBODIMENTS

Figure 1:
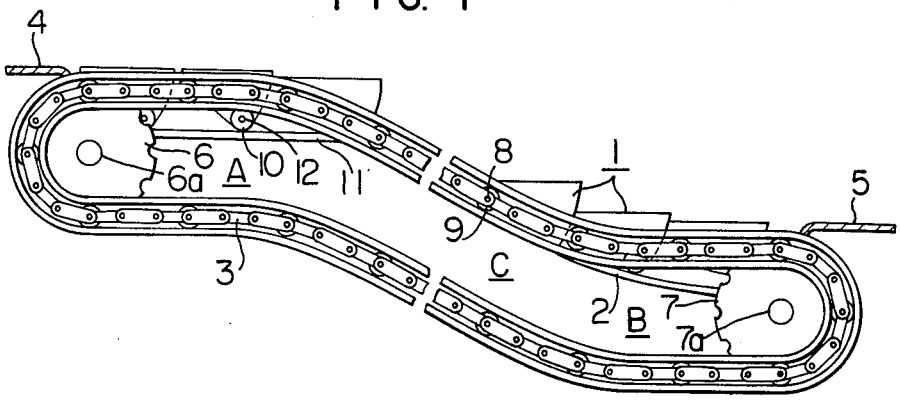
FIG. 1 is a schematic side elevational view of an escalator incorporating the steps in accordance with the present invention.

An escalator comprises an endless series of steps 1 moved by endless chains 3 along a track 2 between an upper landing 4 and a lower landing 5. Each endless chain 3 extends around a sprocket wheel 6 at the upper landing 4 and also around a second sprocket wheel 7 at the lower landing 5. The upper and lower sprocket wheels 6 and 7 are secured to shafts 6*a* and 7*a*, respectively, which are rotatably supported in conventional manner. The chains 3 support shafts 8 which support steps 1 at equal intervals. Each shaft 8 rotatably supports a wheel 9 which is moved on the track 2.

The track 2 comprises an upper section A, a lower section B and an intermediate section C which is inclined at an angle of 30° to the horizontal.

Each step 1 includes a shaft 12 supporting a wheel 10 which is moved along a track 11. The wheels 10 and 9 are spaced a distance in the direction of movement of the step 1. Similar shafts and wheels are provided in the opposite sides of each step 1.

Figure 2:
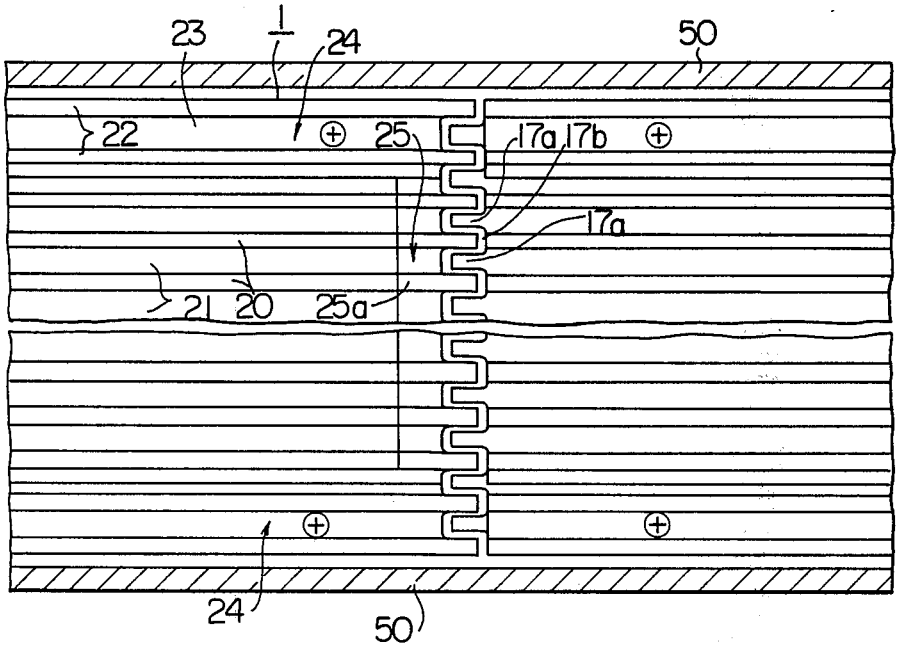
FIG. 2 is an enlarged fragmentary top plan view of two steps and skirt guards shown in FIG. 1.
Figure 3:
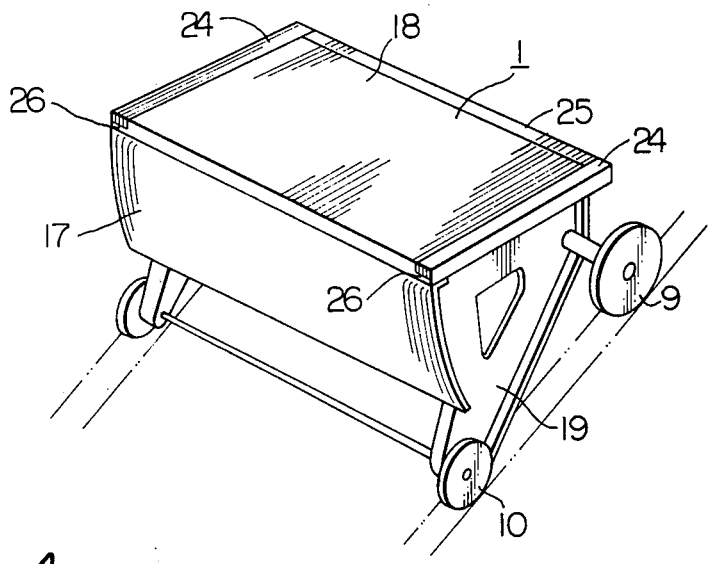
FIG. 3 is a perspective view of one step.

Referring to FIGS. 2 and 3, each step 1 comprises a riser 17, a tread 18 and side frame members 19 which are secured together to form a unitary structure. The tread 18 includes a plurality of cleats 20 formed in the central zone of the tread and extending in the direction of movement of the step. The cleats 20 are laterally spaced one from another to define grooves 21 therebetween. At the opposite side edge zones of the tread 18, there are provided side edge members 24 of a plastic material (normally of yellow color) formed with the cleats 22 which are laterally spaced by a groove 23. The tread 18 is also provided with a comb-shaped front end member 25 of a similar colored plastic material. The side edge members 24 are intended principally to cover the side edge sections or mounting sections 26 of the tread 18, as will be discussed later, but the side edge members 24 are also operative to warn passengers to keep out of skirt guards 50 when the side edge members 24 are colored. Namely, the colored side edge members 24 are effective to draw passengers' attention to the dangerous gap between the skirt guards 50. The front end member 25 is provided with cleats 25*a* which are adapted to mesh with grooves 17*b* formed between cleats 17*a* of the riser 17 to avoid entrance of objects between the riser 17 and the tread 18.

Figure 4:
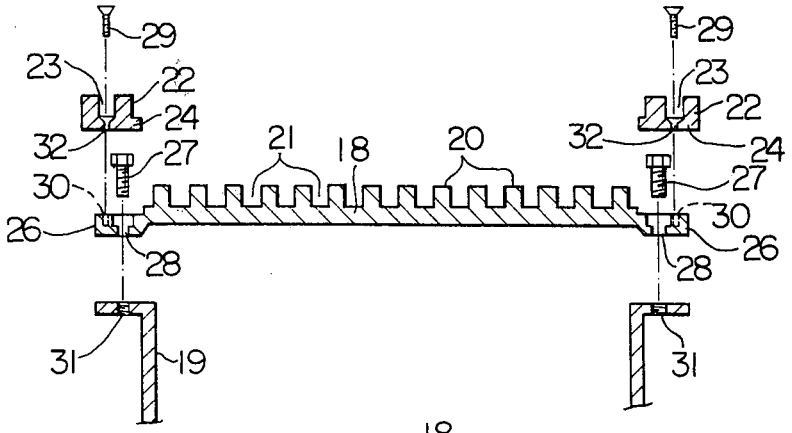
FIG. 4 illustrates, in an exploded sectional view, the structural components of the step to show the connection between a tread and side frame members.
Figure 5:
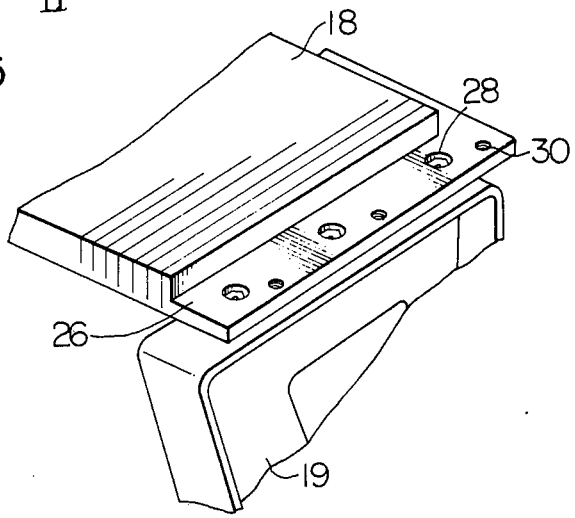
FIG. 5 is an enlarged fragmentary perspective view of the step showing the connection between the tread and a side frame member.

FIGS. 4 and 5 illustrate how to connect a tread 18 to a side frame member 19. The tread 18 is made of die-cast aluminium and includes integral mounting sections 26 formed along the opposite side edges. The mounting sections 26 are recessed and do not have cleats thereon. Through-holes 28 for bolts 27 are formed in the mounting sections 26. The mounting sections are also provided with threaded holes 30 for threadable engagement with screws 29 extending through the side edge members 24 to be fitted onto the recessed mounting sections 26. The reason why the through-holes 28 are employed for the bolts 27 is because, even if the holes 28 are not precisely correctly positioned relative to the threaded screw holes 30, the screws 29 and the bolts 27 can all be tightened. Each side frame member 19 is formed with threaded holes 31 which are aligned with the through-holes 28. The holes 31 may alternatively be mere through-holes and nuts (not shown) may be secured to the underside of the side frame section 19 by welding, for example, so that the nuts thus secured function as threaded holes.

In order to mount the tread 18 on the side frame members 19, bolts 27 are inserted into the through-holes 28 and screwed into the threaded holes 31 to tighten the tread 18 onto the side frame members 19 (see FIG. 5). Then, the side edge members 24 are placed in the recessed mounting sections 26 of the tread 18 and secured thereto by screws 29 inserted into through-holes 32 in the side edge members 24 and screwed into the screw holes 30 formed in the mounting sections 26. The side edge members 24 placed over the mounting sections 26 not only prevent the bolts 27 from being loosened out of their holes but also assure safety which the tread 18 would lack if the tread were not provided with cleats 22 along the side edges thereof. In addition, the side edge members 24 of the illustrated embodiment of the invention are colored for the sake of safety, as described above, but the side edge members 24 may be made of the same material and color as those of the tread 18 in the case where the side edge members 24 are intended solely to cover the mounting sections 26 of the tread 18. The places of the mounting sections 26 are not limited to the side edge zones of the tread 18 and, in fact, the mounting sections may alternatively be positioned at central zone, front zone, rear zone or areas slightly inward of the side edge sections of the tread 18.

In the illustrated embodiment of the invention, the bolts 27 used to mount the treads 18 on side frame members 19 are of diameters as large as approximately 8 mm. Thus, the number of bolts 27 required to mount a tread 18 onto a pair of side frame members 19 is considerably reduced as compared with the prior art (In the illustrated embodiment of the invention, a total of six bolts 27, three for each side edge of a tread 18, are used to secure a tread 18 onto a pair of side frame members 19.). The reduction in the number of the bolts 27 used to mount treads 18 onto side frame members 19 assures decrease in the number of steps required for drilling holes in the treads 18 and the side frame members 19 and, accordingly, facilitates simplified and easy assembly of these members. In addition, since the operation to mount a tread 18 onto side frame members 19 or to remove the tread therefrom can be made from above the tread, the described embodiment of the invention provides an additional advantage to be discussed hereunder.

Conventional treads and side frame members are secured together by means of bolts and nuts. Thus, when some of the cleats of a tread are broken, the operation to remove this tread cannot be done from above the tread. Namely, the first step to remove the broken tread is to move the step from the endless chains. More specifically, a workman is required to enter an upper machine room, to move thereto the step having the broken tread, to disconnect this step from the chains, to transfer the disconnected step onto the ground surface and to remove the broken tread from this step. According to the illustrated embodiment of the invention, however, the removal of a tread 18 from associated side frame members 19 can simply be effected from above the tread.

In the illustrated embodiment of the invention, the side edge members 24 are designed to have cleats 22 so as to match the appearance of the side edge members with that of the associated treads 18. However, in the case where the side edge members 24 are solely intended to cover the mounting sections 26 of treads 18 (in this case, the side edge members may be called "covering members"), the side edge members are not required to have the cleats 22 thereon. In addition, cleats, even if provided on side edge members 24, are not necessarily required to extend in the direction of movement of steps.

Figure 6:
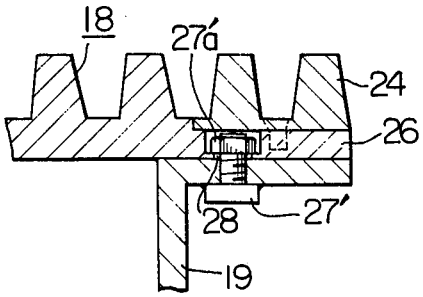
FIG. 6 is an enlarged fragmentary sectional view of a modified step showing a modified connection between the tread and the side frame member.

FIG. 6 shows a modification in which bolts (one of which is shown at 27') are preliminarily secured to the undersurfaces of each side frame member 19 and extend upwardly through the through-holes 28 in the tread 18. A nut 27*a* is screwed over each bolt 27' to secure the tread 18 to the side frame member 19. The modification provides advantages similar to those obtained from the embodiment previously described.

Figure 7:
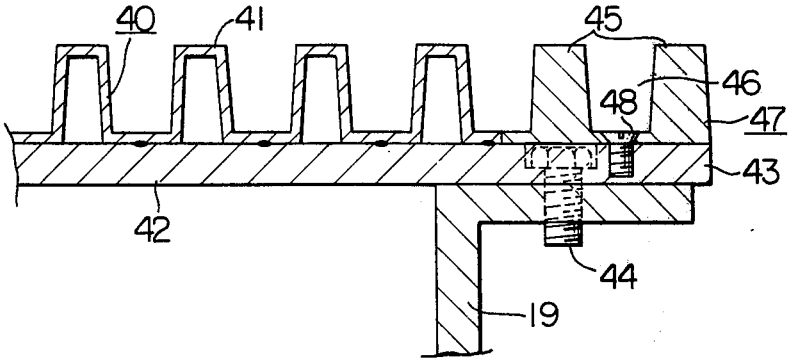
FIG. 7 is a fragmentary sectional view of a second embodiment of the invention comprising a tread including a corrugated top plate of steel sheet and a reinforcement member or base through which the top plate is mounted on side frame members.

FIG. 7 shows a second embodiment of the invention in which the tread 18 of die-cast aluminium is replaced by a modified tread 40 consisting of a corrugated top plate 41 of stainless steel sheet and a reinforcement plate or base 42 (which may consist of a single plate or a plurality of plates). The two members 42 and 41 are secured together by welding. The base 42 has a widthwise dimension which is greater than that of the corrugated top plate 41 to provide mounting sections 43 along the opposite side edges of the top plate 41. The tread 40 thus formed is secured to a side frame member 19 by bolts (one of which is shown by 44) which extend through the mounting section 43 and screwed into threaded holes formed in the side frame member 19. The mounting section 43 is covered with a side edge member 47 having a pair of cleats 45 defining a groove 46 therebetween. The side edge member 47 is secured to the mounting section 43 by means of screws (one of which is shown by 48) extending through holes formed in the bottom of the groove 46 and screwed into threaded holes formed in the mounting section 43. The embodiment illustrated in FIG. 7 provides advantages similar to those provided by the first embodiment of the invention.

Figure 8:
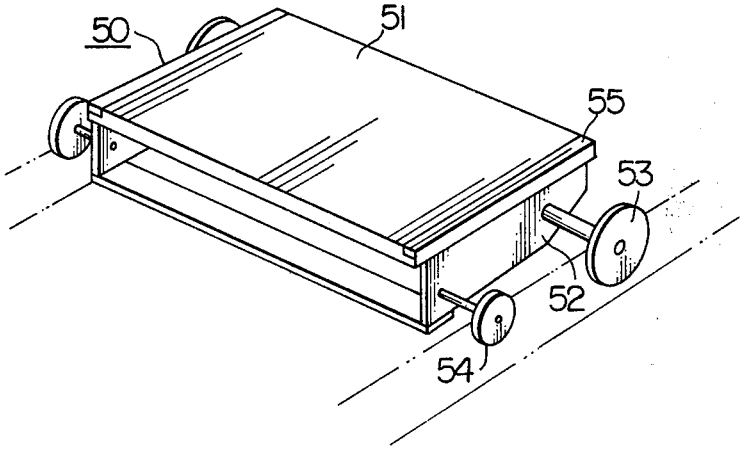
FIG. 8 is a perspective view of a third embodiment of the conveyor step of the invention employed for a moving sidewalk.

FIG. 8 shows a step 50 of a moving sidewalk. The step 50 comprises a tread 51, side frame members 52, wheels 53 and 54 and side edge members 55. The tread 51, the side frame members 52 and the side edge members 55 are assembled and connected together in a manner similar to that in the preceding embodiments.

In general, moving sidewalks move in a substantially horizontal plane. Thus, each step 50 is not required to have riser and comb-shaped front edge member. In addition, in the case of moving sidewalks, no person will be pinched between steps 50 and skirt guards. Thus, the side edge members 55 are not required to be colored. The side edge members 55, however, may be colored in order to improve their design and outer appearance and/or to provide their interchangeability with the side edge members for use with escalator steps.

The embodiment shown in FIG. 8 also provides advantages similar to those of the preceding embodiments so long as the mounting and replacement of the treads are concerned.

As described, the present invention provides an advantage that, since each of the treads is connected to associated side frame members by bolts extending through holes formed in mounting sections of the tread where no cleat is formed, the bolts may be of a large diameter and thus the necessary number of the bolts can be reduced compared with the prior art.

In addition, since the steps of passenger conveyor according to the present invention are constructed such that the mounting and removal of the tread of each step can be effected from above the tread, the replacement of a tread with broken cleats therein can be simplified.

What is claimed is:

1. A step for a passenger conveyor, comprising a tread formed with a plurality of cleats defining grooves therebetween and adapted to mesh with comb-shaped teeth provided on step-on and step-out landings, and frame means on which said tread is mounted, wherein said tread is formed with substantially planar mounting sections having no cleats and extending longitudinally along opposite side edges of the tread, a first set of fastener means for removably mounting said tread at said substantially planar mounting sections on said frame means, said first set of fastener means being disposed so as to be freely accessible from above the mounting sections, a plurality of small covering members for respectively covering the mounting sections, each of the covering members are provided with at least two cleats defining a groove therebetween, and a second set of fastener means for removably mounting the respective covering members on the substantially planar mounting sections, said second set of fastener means being freely accessible from above the covering members.

2. The passenger conveyor step according to claim 1, wherein said tread is integral with said mounting section.

3. A step for a passenger conveyor, comprising a tread formed with a plurality of cleats defining grooves therebetween and adapted to mesh with comb-shaped teeth provided on step-on and step-out landings, and frame means on which said tread is mounted, wherein said tread is provided with substantially planar mounting sections having no cleats and extending longitudinally along opposite side edges of said tread, a first set of fastener means for removably mounting said tread at said substantially planar mounting sections on said frame, said first set of fastener means being disposed so as to be freely accessible from above the mounting sections thereby enabling mounting and removal of said tread from above the tread, a plurality of covering members each made of a plastic material for respectively covering the mounting sections, each of the covering members are provided with at least two cleats defining a groove therebetween, a second set of fastener means for removably mounting the respective covering members on the substantially planar mounting sections, said second set of fastener means being freely accessible from above the covering members thereby enabling the mounting and removal of said covering members from above said covering members, said tread is provided with holes in said substantially planar mounting sections, said frame means is provided with threaded holes respectively aligned with said holes in said substantially planar mounting sections, said first set of fastener means includes bolts extending through said holes in said substantially planar mounting sections and threadably inserted into said threaded holes in said frame means to secure said tread and said frame means together, said covering members are provided with holes formed in the bottom of the grooves formed therein, said holes in said covering members have a diameter less than a diameter of said holes in said substantially planar mounting sections of said tread, said tread being provided with further threaded holes formed in said substantially planar mounting sections, said further threaded holes being respectively aligned with said holes in said covering members, and said second set of fastener means includes screws extending through said holes in said covering members and threadably inserted into said further threaded holes in said tread to removably secure said covering members and said tread together.

4. The passenger conveyor step according to claim 1, wherein said at least two cleats in said covering members, extend in a direction of travel of said step.

5. The passenger conveyor step according to claim 1 or 4, wherein said covering members are made of a colored plastic material.

6. The passenger conveyor step according to claim 1, wherein said tread is integral with said mounting section.

7. The passenger conveyor step according to claim 3, wherein said at least two cleats in said covering members extend in a direction of travel of said step.

8. The passenger conveyor step according to claim 1, wherein said tread is provided with holes formed in said substantially planar mounting sections, said frame means are provided with threaded holes respectively aligned with said holes in said tread, and said first set of fastener means includes bolts of large diameter extending through the holes in said tread and threadably inserted into said threaded holes in said frame means to secure said tread and said frame means together.

9. The passenger conveyor step according to one of claims 1 or 8, wherein said covering members are provided with holes formed in the bottom of said groove, said holes in said covering members have a diameter less than a diameter of said holes in said substantially planar mounting sections said tread is formed with further threaded holes formed in said substantially planar mounting sections and aligned with said holes in said covering members and said second set of fastener means includes screws extending through the holes in said covering members and threadably inserted into the further threaded holes in said tread to secure the covering members and said tread together.

10. The passenger conveyor step according to one of claims 1 or 3, wherein said tread comprises a corrugated top plate of steel and a reinforcement member secured to said corrugated top plate by welding, said reinforcement member extending beyond side edges of said corrugated top plate to form said substantially planar mounting sections along said top plate side edges.

* * * * *